United States Patent [19]

Asami

[11] Patent Number: 4,879,206

[45] Date of Patent: Nov. 7, 1989

[54] SILVER HALIDE COLOR PHOTOGRAPHIC MATERIAL

[75] Inventor: Masahiro Asami, Kanagawa, Japan

[73] Assignee: Fuji Photo Film Co., Ltd., Kanagawa, Japan

[21] Appl. No.: 290,201

[22] Filed: Dec. 27, 1988

Related U.S. Application Data

[63] Continuation of Ser. No. 892,014, Aug. 1, 1986, abandoned.

[30] Foreign Application Priority Data

Aug. 5, 1985 [JP] Japan ..... 60-172017

[51] Int. Cl.[4] ..... G03C 1/19; G03C 1/20; G03C 7/34

[52] U.S. Cl. ..... 430/550; 430/552; 430/553; 430/567

[58] Field of Search ..... 430/550, 552, 553, 567

[56] References Cited

U.S. PATENT DOCUMENTS

| | | | |
|---|---|---|---|
| 4,414,306 | 11/1983 | Wey et al. | 430/569 |
| 4,425,426 | 1/1984 | Abbott et al. | 430/567 |
| 4,439,520 | 3/1984 | Kofron et al. | 430/434 |
| 4,513,081 | 4/1985 | Okazaki et al. | 430/550 |
| 4,564,586 | 1/1986 | Aoki et al. | 430/553 |

FOREIGN PATENT DOCUMENTS 166955 9/1984 Japan .

*Primary Examiner*—Paul R. Michl
*Assistant Examiner*—Mark R. Buscher
*Attorney, Agent, or Firm*—Sughrue, Mion, Zinn, Macpeak & Seas

[57] ABSTRACT

A silver halide color photographic material which comprises a support having provided thereon at least one silver halide emulsion layer containing a cyan dye image-forming coupler represented by the following general formula (I), wherein the emulsion layer comprises silver bromide grains or silver chloro-bromide grains in which tabular grains having a mean aspect ratio of 5 or more amount to 50% or more based on the total projection area of the whole grains, and which are spectrally sensitized with a cyanine dye of the trimethine or pentamethine type or a merocyanine dye, which dye has a desensitization degree of 10 or more, thereby achieving high sensitivity and excellent fastness of photographic images and ensuring uniform quality in mass production:

(I)

wherein $R_1$ and $R_2$ each represents a substituted or unsubstituted aliphatic, aromatic or heterocyclic group; $R_3$ represents a hydrogen atom, a halogen atom, a substituted or unsubstituted aliphatic or aromatic group or an acylamino group, and further $R_3$ may be non-metallic atomic groups which form with $R_2$ a nitrogen-containing 5- or 6-membered ring; $Y_1$ represents a hydrogen atom, or a group which is eliminable upon an oxidative coupling reaction with a developing agent; and n represents 0 or 1; and further the coupler may take a polymeric form, including a dimeric form, via a group represented by $R_1$, $R_2$ or $Y_1$.

4 Claims, No Drawings

SILVER HALIDE COLOR PHOTOGRAPHIC MATERIAL

This is a continuation of application Ser. No. 892,014, filed Aug. 1, 1986, now abandoned.

FIELD OF THE INVENTION

The present invention relates to a color photographic light-sensitive material which can form a color photographic image excellent in keeping quality and, more particularly, to a silver halide color photographic material capable of not only forming a color image which suffers little from both optical and thermal discoloration and, therefore, keeps its initial color balance under long range preservation, but also restraining fluctuations in photographic properties upon its production, that is, ensuring uniformity of quality in mass production.

BACKGROUND OF THE INVENTION

Good keeping quality under various conditions is required of color photographic images formed by the oxidative coupling of dye image-forming couplers (which are abbreviated as couplers, hereinafter) with a color developing agent. In effecting an improvement in keeping quality, it is necessary to ensure that developed color images differing in hue become discolored or change their colors at the lowest possible speed, and also to ensure that the images are of nearly equal discoloring speed over the whole density range, that is to say, to ensure that color balance remains unaltered among the dye images even after the lapse of a long period of time.

However, conventional photographic materials, particularly color paper, are subject to change in color balance since cyan dye images deteriorate to a great extent through long range dark discoloration due to the influences of moisture and heat thereon. Therefore, it is strongly desired to minimize such a change.

In Japanese Patent Application (OPI) Nos. 80045/81 (corresponding to U.S. Pat. No. 4,334,011) and 10433/81 (corresponding to U.S. Pat. No. 4,327,173) (the term "OPI" as used herein refers to a "published unexamined Japanese patent application"), Japanese Patent Publication No. 37857/82 (corresponding to U.S. Pat. No. 4,333,999), Japanese Patent Application (OPI) Nos. 105229/83 (corresponding to U.S. Pat. No. 4,430,423) and 24547/85 (corresponding to U.S. Pat. No. 4,565,777), and so on, it is stated that phenol type couplers in which the benzene ring is substituted by acylamino groups at the 2- and 5-positions (so-called 2,5-diacylaminophenol type couplers) have decided superiority in fastness of cyan dye images produced therefrom, that is to say, the described phenol type couplers offer the possibility of solving the above-described problem.

As reported therein, 2,5-diacylaminophenol type couplers are very useful couplers for the production of color photographic images having good keeping quality, especially high fastness to heat. Moreover, photographic materials prepared using such couplers are known to possess excellent processing stability, and particularly, are known to suffer little from a lowering of cyan density at the stage of bleach-fix processing. Namely, they are excellent in color restoration also.

As described above, 2,5-diacylaminophenol type couplers are preferred as cyan dye-forming couplers for use in color photographic light-sensitive materials.

However, great difficulties have so far attended the attempts to mass produce photographic lightsensitive materials which have the same quality in each of the products when 2,5-diacylaminophenol type couplers are incorporated into the light-sensitive material. This is because what grade of photographic properties the resulting photographic material can have depends largely upon the time elapsed from the preparation of an emulsion containing a 2,5-diacylaminophenol type coupler until the coating of the emulsion. In equipment for mass producing a photographic light-sensitive material, it is difficult to achieve equalization of the time elapsed from the preparation of each emulsion to be coated until the coating of the emulsion on a support. Such a fluctuation in photographic properties resulting from 2,5-diacylaminophenol type couplers are a serious obstacle to mass production of a photographic light-sensitive material having standardized properties. It has been known that the influence of 2,5-diacylaminophenol type couplers on an adsorbed condition of spectral sensitizing dyes at the individual surfaces of silver halide grains is responsible for the variation of photographic properties which depends on the time elapsed until the prescribed emulsion is coated. As a means of solving the above-described problem, therefore, it has been proposed to employ spectral sensitizing dyes of the kind which are hardly affected or influenced by the 2,5-diacylaminophenol type coupler upon their adsorbed condition. Such a means is embodied, e.g., in Japanese Patent Application (OPI) Nos. 166955/84 and 214030/84.

However, it is, in general, considerably difficult from the practical point of view, as described below, to select such a sensitizing dye as not to cause any fluctuations in photographic properties in the case where a photographic light-sensitive material is mass produced utilizing a 2,5-diacylaminophenol type coupler.

This is because photographic properties affected by spectral sensitizing dyes are not confined to fundamental ones including spectral sensitizing strength and wavelength region, but their influences extend to multifarious photographic properties, such as illumination dependence of the sensitivity of photographic emulsions, keeping quality of latent images, freshness keeping capability under long range storage, and so on. Therefore, sensitizing dyes which are hardly affected or influenced by 2,5-diacylaminophenol type couplers present therewith can not always contribute to all of the above-described photographic properties to a satisfactory extent.

Under these circumstances, it may safely be said that the fluctuation in photographic properties due to 2,5-diacylaminophenol type couplers is still a great obstacle when the contribution of spectral sensitizing dyes to photographic properties is considered.

SUMMARY OF THE INVENTION

Accordingly, an object of the present invention is to provide a silver halide color photographic material which can not only form a color image suffering little from both optical and thermal discoloration and losing little the color balance under long range preservation, but also restrain fluctuations in photographic properties upon mass production thereof and ensure standardized quality to the mass produced products.

The above-described object of the present invention is achieved with a silver halide color photographic material having on a support a silver halide emulsion in which a cyan coupler represented by the following general formula (I) is incorporated, with the silver halide emulsion comprising silver bromide or silver chlorobromide grains sensitized spectrally with a cyanine dye of the trimethine or pentamethine type or a merocyanine dye, which dye has a desensitization degree of 10 or more when determined in accordance with the testing method defined hereinafter, in which tabular grains having a means aspect ratio of not less than 5 amount to 50% or more based on the total projection area of the whole grains:

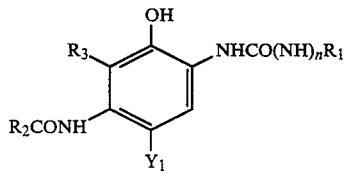

(I)

wherein $R_1$ and $R_2$ each represents a substituted or unsubstituted aliphatic, aromatic or heterocyclic group; $R_3$ represents a hydrogen atom, a halogen atom, a substituted or unsubstituted aliphatic or aromatic group or an acylamino group, and further $R_3$ may be a non-metallic atomic group which forms with $R_2$ a nitrogen-containing 5- and 6-membered ring; $Y_1$ represents a hydrogen atom, or a group which is eliminable upon an oxidative coupling reaction with a developing agent; and n represents 0 or 1; and further, the coupler may take a polymeric form, including a dimeric form, via a group represented by $R_1$, $R_2$, or $Y_1$.

DETAILED DESCRIPTION OF THE INVENTION

The expression "aliphatic group" as used herein is intended to include saturated and unsaturated aliphatic hydrocarbon residues which may take any form, such as that of a straight chain, a branched chain or a circle, with specific examples including alkyl groups, alkenyl groups, alkinyl groups and so on.

Cyan couplers to be employed in the present invention, which are represented by the foregoing general formula (I), are illustrated below in greater detail.

Specific examples of $R_1$ and $R_2$ in the foregoing general formula (I) include aliphatic groups containing 1 to 31 carbon atoms (e.g., a methyl group, a butyl group, an octyl group, a tridecyl group, an isohexadecyl group, a cyclohexyl group, etc.), aryl groups (e.g., a phenyl group, a naphthyl group, etc.), and heterocyclic groups (e.g., a 2-pyridyl group, a 2-thiazolyl group, a 2-imidazolyl group, a 2-furyl group, a 6-quinolyl group, etc.). These groups each may have a substituent group selected from among an alkyl group, an aryl group, a heterocyclic group, an alkoxy group (e.g., a methoxy group, a 2-methoxyethoxy group, a tetradecyloxy group, etc.), an aryloxy group (e.g., a 2,4-di-tert-amylphenoxy group, a 2-chlorophenoxy group, a 4-cyanophenoxy group, a 4-butanesulfonamidophenoxy group, etc.), a acyl group (e.g., an acetyl group, a benzoyl group, etc.), an ester group (e.g., an ethoxycarbonyl group, a 2,4-di-tert-amylphenoxycarbonyl group, an acetoxy group, a benzoyloxy group, a butoxysulfonyl group, a toluenesulfonyloxy group, etc.), an amido group (e.g., an acetylamino group, a butanesulfonamido group, a dodecylbenzenesulfonamido group, a dipropylsulfamoylamino group, etc.), a carbamoyl group (e.g., a dimethylcarbamoyl group, an ethylcarbamoyl group, etc.), a sulfamoyl group (e.g., a butylsulfamoyl group, etc.), an imido group (e.g., a succinimido group, a hydantoinyl group, etc.), a ureido group (e.g., a phenylureido group, a dimethylureido group, etc.), a sulfonyl group (e.g., a methanesulfonyl group, a carboxymethanesulfonyl group, a phenylsulfonyl group, etc.), an aliphatic or aromatic thio group(e.g., a butylthio group, a phenylthio group, etc.), a hydroxyl group, a cyano group, a carboxyl group, a nitro group, a sulfo group, a halogen atom and so on. When a group represented by $R_1$ or $R_2$ has two or more substituent groups, they may be the same or different.

Specific examples of $R_3$ include a hydrogen atom, a halogen atom (e.g., a chlorine atom, a bromine atom, etc.), an alkyl group (e.g., those containing 1 to 20, preferably 1 to 6, carbon atoms), an aryl group (e.g., a phenyl group, etc.), an acylamino group (e.g., an acetylamino group, a benzoylamino group, etc.), and a non-metallic atomic group capable of forming with $R_2$ a nitrogen-containing 5- or 6-membered hetero ring such as illustrated below. These groups each may have a substituent group which may be selected from the same substituent groups as for $R_1$ and $R_2$ recited above.

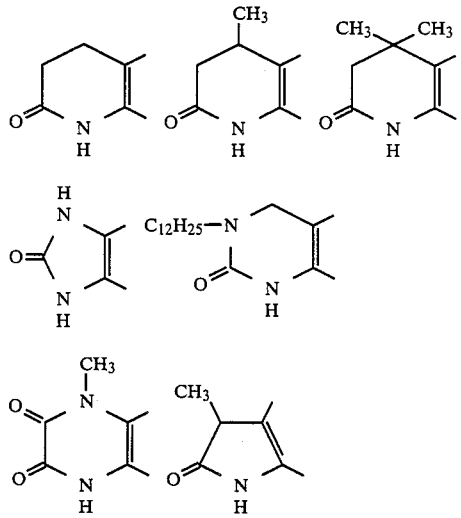

$Y_1$ represents a hydrogen atom or a coupling eliminable group, with the specific examples including a halogen atom (e.g., a fluorine atom, a chlorine atom, a bromine atom, etc.), an alkoxy group (e.g., an ethoxy group, a dodecyloxy group, a methoxyethylcarbamoylmethoxy group, a carboxypropyloxy group, a methylsulfonylethoxy group, etc.), an aryloxy group (e.g., a 4-chlorophenoxy group, a 4-methoxyphenoxy group, a 4-carboxyphenoxy group, etc.), an acyloxy group (e.g., an acetoxy group, a tetradecanoyloxy group, a benzoyloxy group, etc.), a sulfonyloxy group (e.g., a methanesulfonyloxy group, a toluenesulfonyloxy group, etc.), an amido group (e.g., a dichloroacetylamino group, a heptafluorobutyrylamino group, a methanesulfonylamino group, a toluenesulfonylamino group, etc.), an alkoxycarbonyloxy group (e.g., an ethoxycarbonyloxy group, a benzyloxycarbonyloxy group, etc), an aryloxycarbonyloxy group (e.g., a phenoxycarbonyloxy group, etc.), an aliphatic, aromatic or heterocyclic thio group (e.g., an ethylthio group, a phenylthio group, a tetrazolylthio group, etc.), an imido group (e.g., a succinimido group, a hydantoinyl group, etc.), an aromatic azo group (e.g., a phenylazo group, etc.), and so on. These eliminable groups each may contain a photographically useful group.

Of the cyan coupler represented by the foregoing general formula (I), those described below are preferred in the present invention.

$R_1$ in the formula (I) is preferably an aryl group or a heterocyclic group, and more preferably an aryl group substituted with a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group.

When $R_2$ and $R_3$ do not form a ring by combining with each other, $R_2$ is preferably a substituted or unsubstituted alkyl or aryl group, a particularly preferably an alkyl group substituted with a substituted aryloxy group, while $R_3$ is a hydrogen atom. Examples of these substituent groups include those for $R_1$ and $R_2$ recited before.

$Y_1$ is preferably a hydrogen atom, a halogen atom, or an alkoxy, aryloxy or sulfonamido group which may be substituted.

In the case of n=0, $Y_1$ is more preferably a halogen atom, and particularly preferably a chlorine atom or a fluorine atom.

Specific examples of cyan couplers represented by the foregoing general formula (I) are illustrated below. However, the present invention should not be construed as being limited to the following examples.

(I-1)

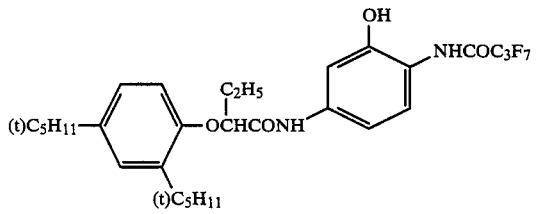

(I-2)

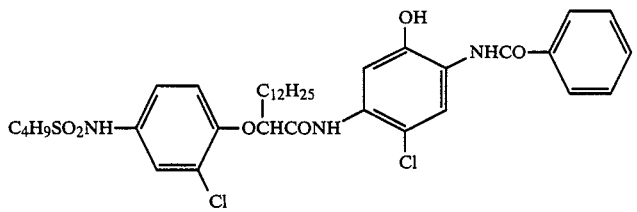

(I-3)

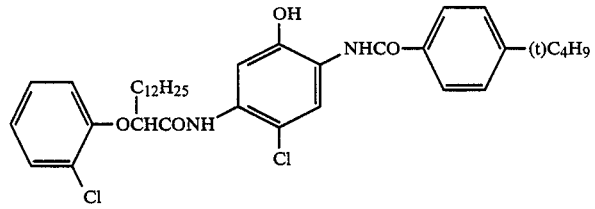

(I-4)

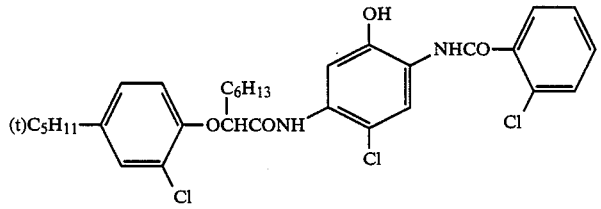

(I-5)

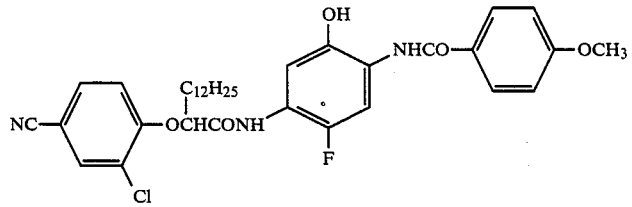

-continued
(I-6)
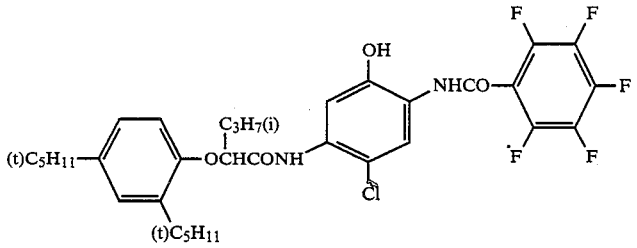
(I-7)
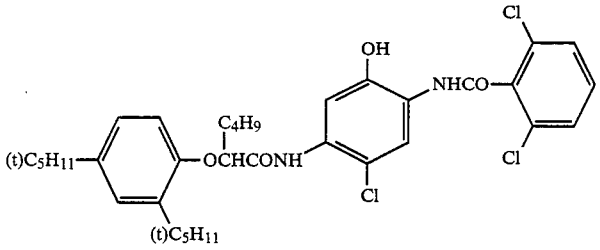
(I-8)
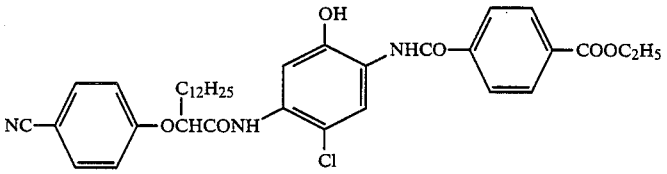
(I-9)
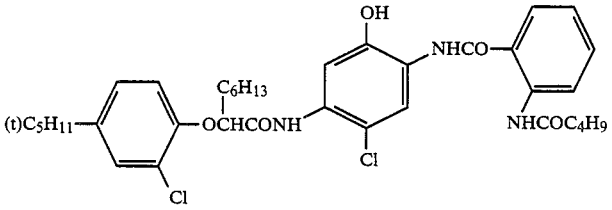
(I-10)
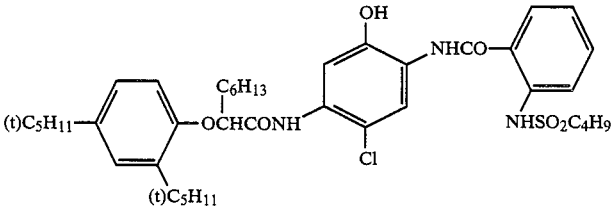
(I-11)
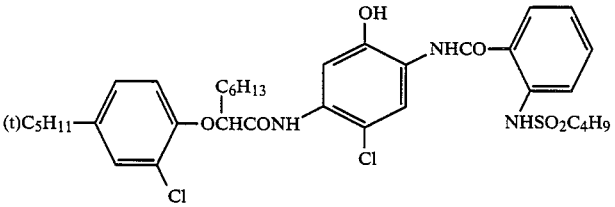
(I-12)
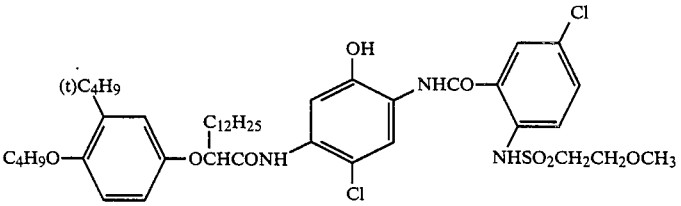

-continued
(I-13)
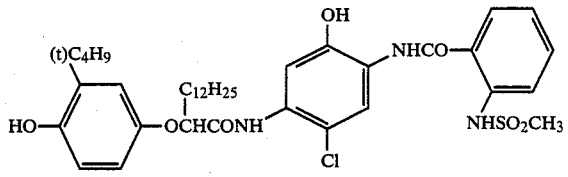
(I-14)
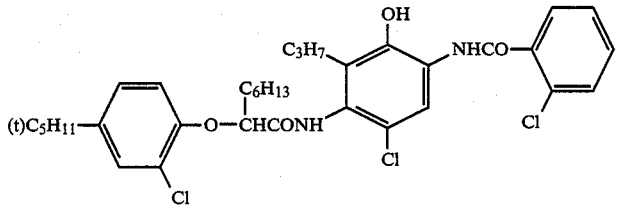
(I-16)
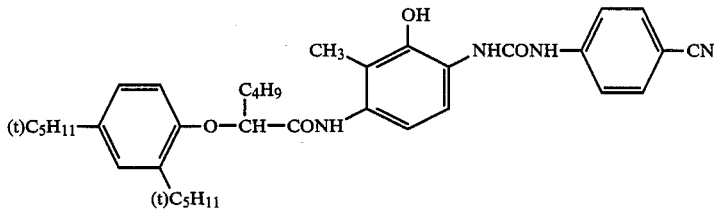
(I-17)
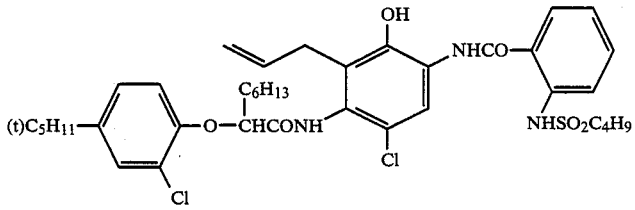
(I-18)
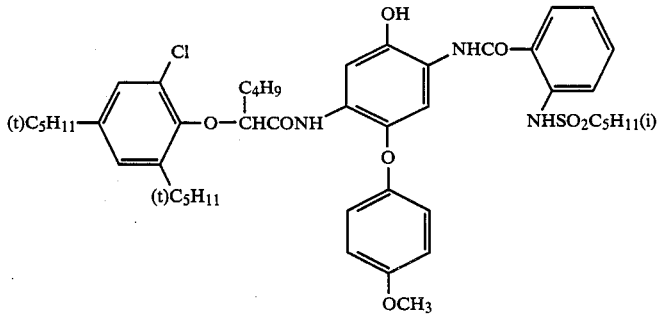
(I-19)
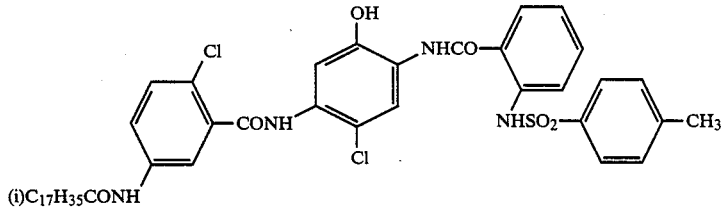
(I-20)
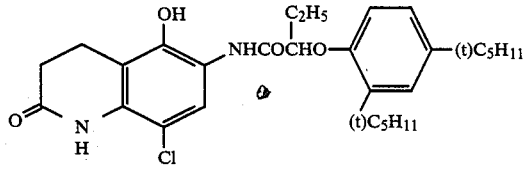

-continued
(I-21)
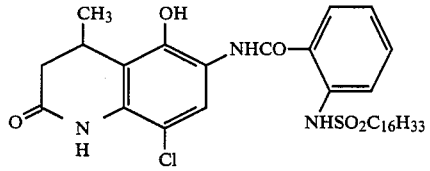
(I-22)
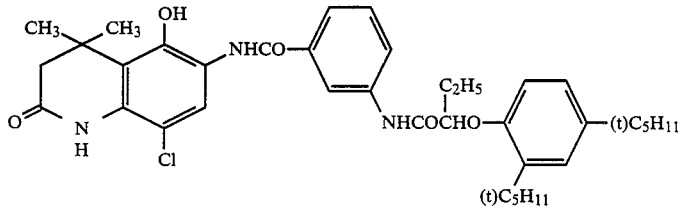
(I-23)
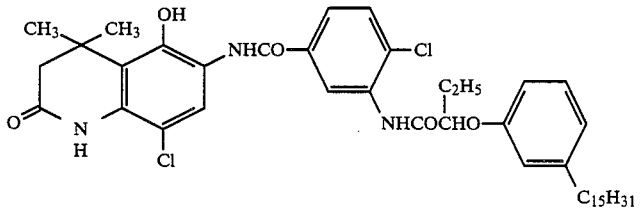
(I-24)
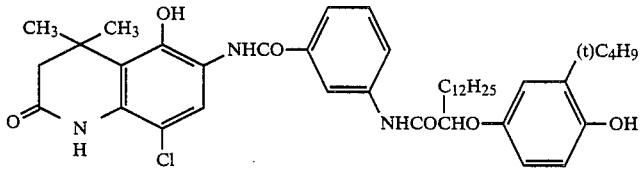
(I-25)
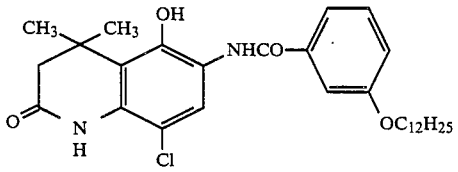
(I-26)
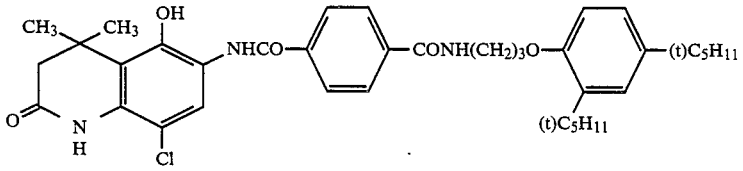
(I-27)
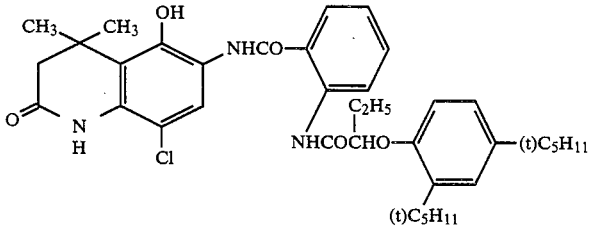

-continued
(I-28)
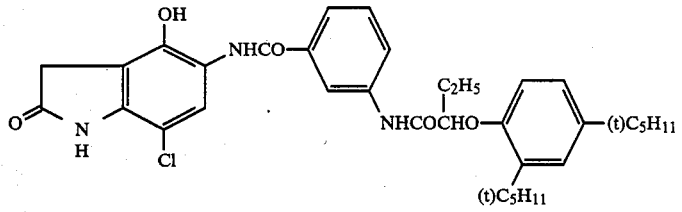
(I-29)
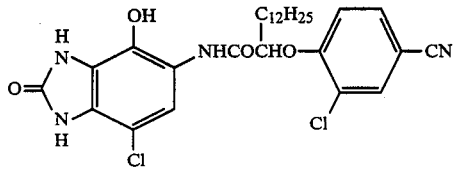
(I-30)
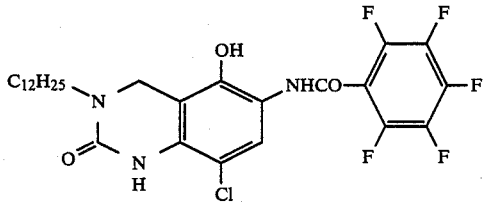
(I-31)
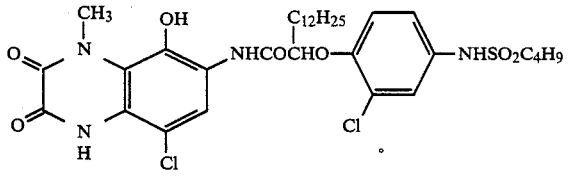
(I-32)
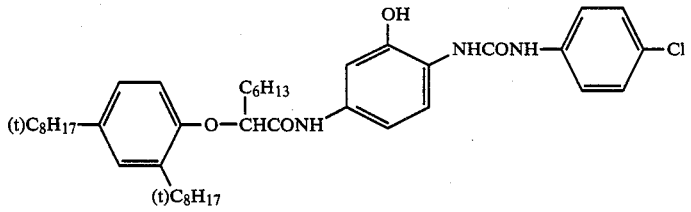
(I-33)
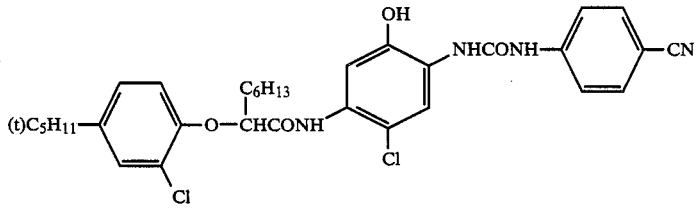
(I-34)
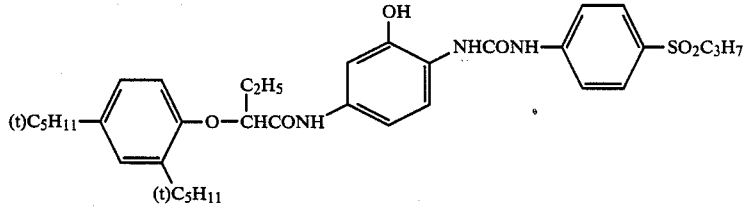

-continued (I-35)

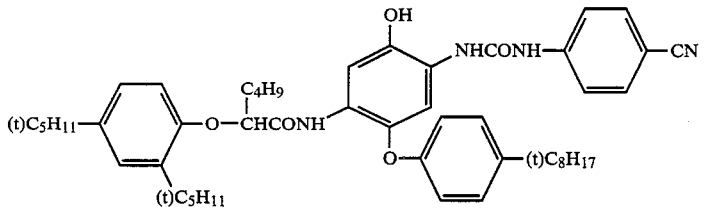

(I-36)

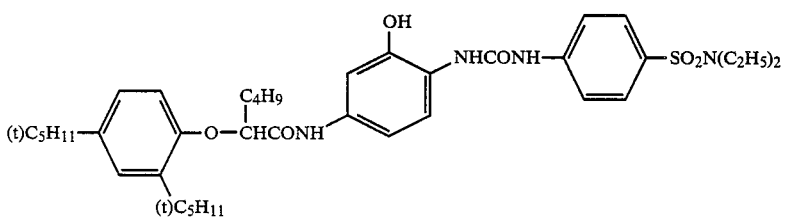

(I-37)

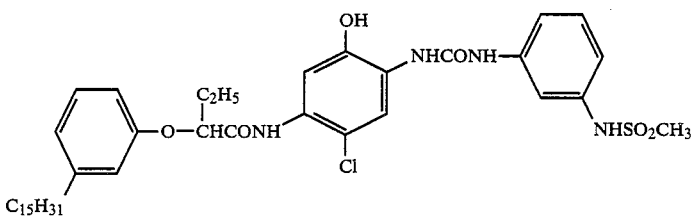

(I-38)

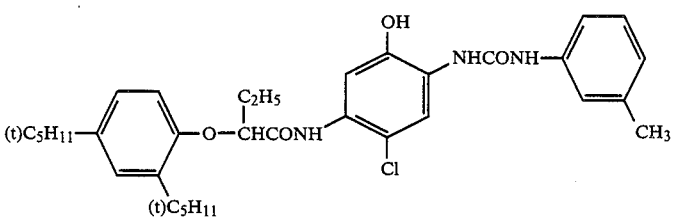

(I-39)

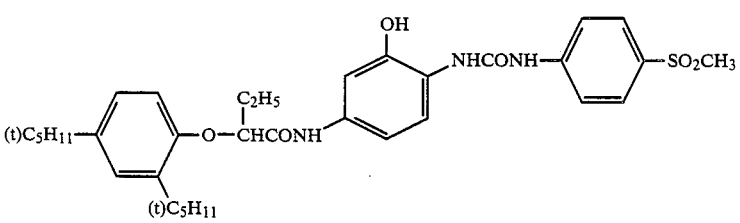

(I-40)

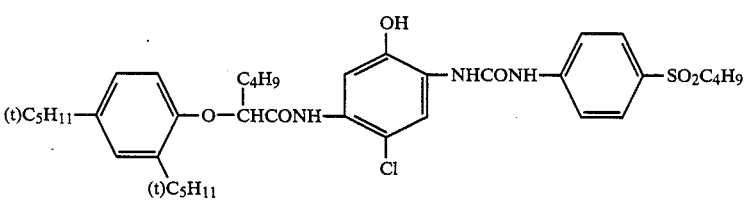

The cyan couplers represented by the general formula (I) are known compounds, and methods for synthesizing them are described, e.g., in Japanese Patent Application (OPI) Nos. 80045/81, 104333/81, 105229/83 and 24547/85, and Japanese Patent Publication No. 37857/82.

A suitable cyanine dye which can be employed in the present invention, which has a desensitization degree of 10 or more, can be selected from conventional cyanine dyes in which the same or different basic heterocyclic nuclei are connected to each other through a trimethine or pentamethine group (which may be substituted with a lower alkyl group, a substituted alkyl group (a substituent group of which may be a phenyl group), or a pair of substituent groups which may be linked to form a ring). Specific examples of basic heterocyclic nuclei include pyrroline, oxazoline, thiazoline, pyrrole, oxazole, thiazole, selenazole, imidazole, tetrazole, pyridine and like nuclei; nuclei formed by fusing together one of the above-described nuclei and an alicyclic hydrocarbon ring; and nuclei formed by fusing together one of the above-described nuclei and an aromatic hydrocarbon ring. More specifically, these fused nuclei include indolenine, benzindolenine, indole, benzoxazole, naphthoxazole, benzothiazole, naphthothiazole, benzoselenazole, benzimidazole, quinoline and like nuclei. These nuclei each may further be substituted with, for example, a halogen atom, an alkyl group, an alkoxy group or an aryl group.

A suitable merocyanine dye which can be employed in the present invention can be selected from conventional merocyanine dyes in which one of the above-described basic heterocyclic nuclei and a nucleus having a ketomethylene structure as illustrated below are connected to each other through a tetramethine group (which may be substituted with a lower alkyl group, a substituted alkyl group, or a pair of substituent groups which may be linked to form a ring). Specific examples of ketomethylene structure-containing nuclei include pyrazoline-5-one, thiohydantoin, 2-thioxazolidine-2,4-dione, thiazolidine-2,4-dione, rhodanine, thiobarbituric acid and like 5- or 6-membered heterocyclic nuclei.

These nuclei each may further be substituted with, for example, a halogen atom, an alkyl group, an alkoxy group or an aryl group.

The cyanine dyes to be employed in the present invention can be selected preferably from those represented by the following general formula (II) or (III):

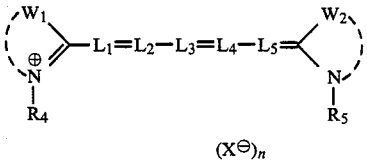

(II)

$(X^{\ominus})_n$

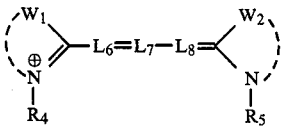

(III)

$(X^{\ominus})_n$ wherein $W_1$ and $W_2$ may be the same or different, and each represents a non-metallic atomic group necessary to complete a benzothiazole nucleus, a naphthothiazole nucleus, a benzoxazole nucleus, or a naphthoxazole nucleus, wherein each nucleus may be substituted with, for example, a halogen atom, an alkyl group, an alkoxy group or an aryl group; $R_4$ and $R_5$ may be the same or different, and each is an alkyl group, or a substituted alkyl group (a substituent group of which may be a carboxy group, a sulfo group, a hydroxy group or so on, which may be attached to the alkyl group through an alkoxy group); $L_1$, $L_2$, $L_3$, $L_4$, $L_5$, $L_6$, $L_7$ and $L_8$ each represents a methine group, or a substituted methine group, and $L_2$ and $L_4$ may further combine with each other to form a ring (e.g., a 6-membered ring); $X^{\ominus}$ represents an anion (e.g., a chlorine ion, an iodine ion, a bromine ion, etc.); and n represents 1 or 0, but n is equal to 0 when the dye forms an inner salt.

On the other hand, the merocyanine dyes to be employed in the present invention can be selected from the tetramethine type merocyanine dyes represented by the general formula (I) illustrated in Japanese Patent Application (OPI) No. 214030/84 (corresponding to U.S. patent application Ser. No. 612,497 (filed on May 21, 1984) or European Patent Application No. 0126455A2).

General formula (I) illustrated in Japanese Patent Application (OPI) No. 214030/84 is as follows:

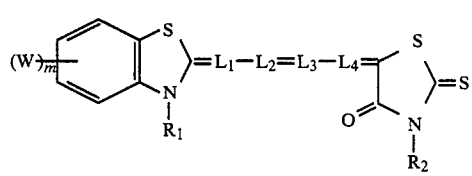

(I)

These sensitizing dyes may be employed individually or in combination. Combinations of sensitizing dyes are often employed for the purpose of supersensitization.

Materials which can exhibit a supersensitizing effect in combination with a certain sensitizing dye, although they themselves do not spectrally sensitize silver halide emulsions or do not absorb light in the visible region, may be incorporated into the silver halide emulsions. For example, aminostilbene compounds substituted with nitrogen-containing heterocyclic groups (e.g., those described in U.S. Pat No. 2,933,390 and 3,635,721), aromatic organic acid-formaldehyde condensates (e.g., those described in U.S. Pat. No. 3,743,510), cadmium salts, azaindene compounds and so on can be used.

The term "desensitization degree" as used in the present invention refers to the value determined by the testing method described below.

Testing Method:

9.14 g of Cyan Coupler (*α) is dissolved in a mixture of 6.2 ml of dibutyl phthalate (DBP) and 15.0 ml of ethyl acetate, and dispersed, in an emulsified condition, into 100 ml of a 10 wt % gelatin solution containing 0.3 g of sodium dodecylbenzenesulfonate to prepare a coupler-emulsified dispersion α.

(*α) Cyan Coupler

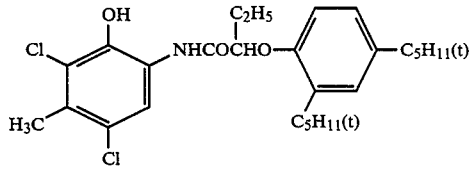

Separately, 11.46 g of the foregoing Cyan Coupler (I-4) is dissolved in a mixture of 6.2 ml of DBP and 15.0 ml of ethyl acetate, and the resulting solution is emulsified and dispersed in 100 ml of a 10 wt % aqueous gelatin solution containing 0.3 g of sodium dodecylbenzenesulfonate to prepare a coupler-emulsified dispersion β.

A trimethine or pentamethine cyanine dye or a merocyanine dye to be tested is dissolved in a proper solvent (for example, methyl alcohol), and added to an emulsion comprising cubic silver chlorobromide grains having a bromide content of 50 mol % in an amount of $1\times10^{-4}$ mol per mol of silver chlorobromide. Thereafter, the emulsion is allowed to stand for 30 minutes at 40° C. to effect spectral sensitization.

The resulting emulsion is divided into two portions, and they are mixed with the coupler-emulsified dispersions α and β, respectively. After the lapse of 10 minutes at 40° C., each of the mixed emulsions is coated on a paper support laminated with polyethylene on both sides. Thus, Sample α and Sample β are produced. In each sample, silver has a coverage of 300 mg/m², the coupler has a coverage of 0.40 mol/m², and gelatin has a coverage of 600 mg/m². Further, gelatin is provided on the emulsion layer at a coverage of 1,500 mg/m$^2$ as a protective layer. In each of the layers, sodium salt of 2,4-dichloro-6-hydroxy-s-triazine is employed as hardener.

Each of the thus produced emulsion-coated samples is subjected to optical exposure and photographic processing in the same manner as disclosed in Example 1 below, followed by determination of a difference in relative sensitivity between Sample $\alpha$ and Sample $\beta$.

The term "desensitization degree" as used in the present invention refers to the thus determined difference in relative sensitivity between Sample $\alpha$ and Sample $\beta$. More specifically, the relative sensitivity of Sample $\alpha$ is taken as 100, and the relative sensitivity of Sample $\beta$ is subtracted therefrom. A value left by the subtraction is the desensitization degree. For instance, a desensitization degree of 10 means that when the relative sensitivity of Sample $\alpha$ is taken as 100, Sample $\beta$ has a relative sensitivity of 90.

It was unforeseen from information accumulated hitherto regarding tubular silver halides (e.g., in U.S. Pat. No. 4,439,520, and Japanese Patent Application (OPI) No. 113934/84) that even if a cyanine or merocyanine dye showing a desensitization degree of 10 or more when determined by the testing method defined above is employed, a photographic light-sensitive material which can restrain fluctuations in photographic properties upon production and ensure uniformity of quality upon mass production can be obtained by using silver bromide or silver chlorobromide grains in which tubular grains having a mean aspect ratio of 5 or more amount to 50% or more based on the total projection area of the whole grains.

A tabular silver halide emulsion which can be used in the present invention is described in detail below.

The term "mean aspect ratio" as used in the description of the tubular silver halide emulsion of the present invention refers to the average of ratios of diameters of the silver halide grains to thicknesses thereof. The term "diameter(s)" herein signifies the diameter of the circle having the same area as the projection area of the grain which is determined by observation under a microscope or an electron microscope. Accordingly, the mean aspect ratio of not less than 5 means that diameters of the circles are on the average 5 times or more the corresponding grain thicknesses.

In the tabular silver halide grains to be used in the silver halide emulsion of the present invention, the grain diameter must be not less than 5 times the grain thickness. Preferably, it is from 5 to 30 times, and particularly from 5 to 8 times. In addition, the tabular silver halide grains are to be present in a fraction of 50% or more, preferably 70% or more, and particularly preferably 85% or more, based on the total projection area of the whole silver halide grains.

The halide composition of the tabular silver halide grains to be used in the present invention is bromide or chlorobromide, and more preferably, chlorobromide containing from 40 mol % to 95 mol % bromide. The distribution of the halides in the individual silver chlorobromide grains may be either uniform throughout or restricted to a particular part. Further, the halide composition may change continuously or discontinuously from the center toward the outside of the individual tabular grains. Also, it may change continuously or discontinuously in the direction of the thickness of each tabular grain. Moreover, two or more kinds of tabular grains differing in halide composition may be used in a blended form, if needed.

The diameter of the tabular silver halide grains ranges from 0.1 to 10 microns, preferably from 0.2 to 5.0 microns, and particularly preferably from 0.3 to 2.0 microns.

A thickness of tabular silver halide grains is represented by the distance between two parallel faces which form the grain.

More desirable tabular silver halide grains which can be used in the present invention are those having a diameter ranging from 0.2 to 2.4 microns, a thickness of 0.3 micron or less and a mean aspect ratio of from 5 to 8. A most advantageous silver halide photographic emulsion which can be used in the present invention is an emulsion in which the tabular silver halide grains having a grain diameter ranging from 0.3 to 2.0 microns and a mean aspect ratio of 5 or more are present in a fraction of 85% or more, based on the total projection area of the whole grains.

The size distribution of the tabular silver halide grains to be employed in the present invention may be either narrow or broad.

Also, two or more kinds of tabular grains differing in size may be used in a blended form depending on the photographic gradation required.

Tabular silver halide emulsions which can be employed in the present invention are described in the reports of Cugnac and Chateau, Duffin, *Photographic Emulsion Chemistry,* pages 66 to 72, The Focal Press, New York (1966); and *Photo. Journal,* edited by A. P. H. Trivelli and W. F. Smith, Vol. 80, page 285 (1940), and they can be easily made by reference to the methods described in Japanese Patent Application (OPI) Nos. 113927/83, 113928/83 and 127921/83, and so on.

For instance, a tabular silver halide emulsion can be obtained in the following manner. Firstly, seed crystals in which tabular grains are present in a proportion of 40% or more by weight are prepared under the condition that the pBr is kept at 1.3 or less, that is, under a relatively high pAg atmosphere and then the seed crystals are made to grow by simultaneous addition of silver and halide solutions under the condition that the pBr is maintained to a similar extent as described above. In the grain growth process, it is desirable to add the silver solution and the halide solution under such a condition as not to cause further nucleation.

The size of the tabular silver halide grains can be adjusted within a desired range by controlling the reaction temperature, selecting the kind and the quality of the solvent to be used, controlling the addition rates of the silver salt and the halide to be used at the time of grain growth, and so on.

In producing the tabular silver halide grains of the present invention, a silver halide solvent can optionally be used, whereby the grain size, the grain shape (e.g., a diameter/thickness ratio, etc.), the grain size distribution, and the rate of grain growth can be controlled. It is preferable to use the solvent in a concentration ranging from $10^{-4}$ to 1.0 wt %, particularly from $10^{-3}$ to $10^{-1}$ wt %, of the reaction solution.

Silver halide solvents which can be employed in the present invention include known ones. Frequently used silver halide solvents are ammonia, thioethers, thioureas, thiocyanates, thiazolinethiones and the like. For details of thioethers U.S. Pat. Nos. 3,271,157, 3,574,628 and 3,790,387, and so on can be referred to. For details of thioureas Japanese Patent Application (OPI) Nos.

82408/78 and 77737/80, for details of thiocyanates U.S. Pat. Nos. 2,222,264, 2,448,534 and 3,320,069, and for details of thiazolinethiones Japanese Patent Application (OPI) No. 144319/78 can be referred to, respectively.

In the process for producing the silver halide grains or allowing the produced grains to ripen physically, cadmium salts, zinc salts, lead salts, thallium salts, iridium salts or complexes thereof, rhodium salts or complexes thereof, iron salts or complexes thereof may be present.

In producing the tabular silver halide grains to be employed in the present invention, it is desirable for the purpose of speeding up the grain growth to employ the methods of increasing addition rates, the addition amounts and the addition concentrations of a silver salt solution (e.g., an aqueous solution of $AgNO_3$) and a halide solution (e.g., an aqueous solution of KBr). For details of these methods the descriptions given, e.g., in British Pat. No. 1,335,925, U.S. Pat. Nos. 3,650,757, 3,672,900 and 4,242,445, and Japanese Patent Application (OPI) Nos. 142329/80 and 158124/80 can be referred to.

The tabular silver halide grains of the present invention can be chemically sensitized, if needed.

For the chemical sensitization, sulfur sensitization processes using active gelatin or compounds containing sulfur capable of reacting with silver ion (e.g., thiosulfates, thioureas, mercapto compounds, rhodanines, etc.), reduction sensitization processes using reducing materials (e.g., stannous salts, amines, hydrazine derivatives, formamidinesulfinic acid, silane compounds, etc.), and noble metal sensitization processes using noble metal compounds (e.g., gold complex salts, and complex salts of Group VIII metals such as Pt, Ib, Pd, etc.) can be employed individually or as a combination thereof.

In particular, it is more advantageous from the viewpoint of saving silver to chemically sensitize the tabular silver halide grains of the present invention using a gold sensitization process, a sulfur sensitization process, or a combination of these processes.

Various kinds of color couplers can also be used in the present invention in addition to the foregoing cyan couplers according to the present invention. Useful color couplers are cyan, magenta and yellow colorforming couplers. Typical examples of these colorforming couplers include naphthol or phenol compounds, pyrazolone or pyrazoloazole compounds, and open chain or heterocyclic ketomethylene compounds. Specific examples of these cyan, magenta and yellow couplers which can be used in the present invention are described in the patents cited in *Research Disclosure,* No. 17643, Section VII-D (Dec., 1978) and ibid., No. 18717 (Nov., 1979).

It is desirable that color couplers to be incorporated in the sensitive material are rendered nondiffusible by containing a ballast group or taking a polymerized form. Moreover, 2-equivalent color couplers which have a coupling eliminable group at the coupling active site are preferred to 4-equivalent ones having a hydrogen atom at that site because the coverage of silver can be reduced. Couplers which can be converted to dyes having a moderate diffusibility as a result of color development, colorless couplers, DIR couplers which can release development inhibitors in proportion as the coupling reaction proceeds, and couplers capable of releasing development accelerators upon the coupling reaction can be also employed.

As representative yellow couplers which can be used in the present invention, mention may be made of oil-protected acylacetamide couplers. Specific examples of such couplers are described in U.S. Pat. Nos. 2,407,210, 2,875,057 and 3,265,506, and so on. In the present invention, 2-equivalent yellow couplers are preferably employed, and typical representative ones are oxygen-eliminable type yellow couplers as described, e.g., in U.S. Pat. Nos. 3,408,194, 3,447,928, 3,933,501 and 4,022,620, and nitrogen-eliminable type yellow couplers as described, e.g., in Japanese Patent Publication No. 10739/83, U.S. Pat. Nos. 4,401,752 and 4,326,024, *Research Disclosures,* No. 18053 (Apr., 1979), British Pat. No. 1,425,020, West German patent application (OLS) Nos. 2,219,917, 2,261,361, 2,329,587 and 2,433,812. Of these yellow couplers, α-pivaloylacetanilide couplers are more advantageous because they can produce fast dyes, especially excellent in fastness to light, and α-benzoylacetanilide couplers have an advantage in that they can provide high color density to developed image.

Magenta couplers which can be employed in the present invention include those of the oil-protected indazolone type, cyanoacetyl type, and pyrazoloazole type, preferably 5-pyrazolone and pyrazolotriazole types. Of the couplers of 5-pyrazolone type, those substituted with an arylamino or acylamino group at the 3-position are preferred over others from the viewpoint of hue and color density of the dye image developed. Representative magenta couplers of such a type are described in U.S. Pat. Nos. 2,311,082, 2,343,703, 2,600,788, 2,908,573, 3,062,653, 3,152,896 and 3,936,015, and so on. Most suitable eliminable groups for 2-equivalent 5-pyrazolone couplers are nitrogen-eliminable groups described in U.S. Pat. No. 4,310,619, and arylthio groups described in U.S. Pat. No. 4,351,897. In addition, ballast group-containing 5-pyrazolone couplers described in European Patent 73,636 can provide high color density to the dye image developed.

Magenta couplers of pyrazoloazole type include pyrazolobenzimidazoles described in U.S. Pat No. 3,061,432, and more preferably pyrazolo[5,1-c][1,2,4]triazoles described in U.S. Pat. No. 3,725,067, pyrazolotetrazoles described in *Research Disclosure,* No. 24220 (June, 1984) and pyrazolopyrazoles described in *Research Disclosure,* No. 24230 (June, 1984). Of these couplers, imidazo[1,2-b]pyrazoles described in European Patent No. 119,741 are more desirable from the standpoint that dye images developed show small side absorption in the yellow region and have high fastness to light. In particular, pyrazolo[1,5-b][1,2,4]triazoles described in European Patent No. 119,860 are preferred over others.

Cyan couplers which can be used together with those of the present invention include oil-protected naphthol and phenol type ones. Representative of such couplers are naphthol couplers described in U.S. Pat. No. 2,474,293, and more preferably oxygen-eliminable 2-equivalent couplers of the naphthol type described in U.S. Pat. Nos. 4,052,212, 4,146,396, 4,228,233 and 4,296,200. Specific examples of couplers of the phenol type are described in U.S. Pat. Nos. 2,369,929, 2,801,171, 2,772,162 and 2,895,826, and so on. Cyan couplers fast to moisture and temperature are preferably used in the present invention, and typical examples thereof include phenol type couplers which have an alkyl group containing 2 or more carbon atoms at the meta-position of the phenol nucleus, as described in U.S. Pat. No. 3,772,002.

Furthermore, couplers which can produce dyes having moderate diffusibility as a result of coupling reaction can be used in the present invention. Specific examples of magenta couplers of such a type are described in U.S. Pat. No. 4,336,237 and British Pat. No. 2,125,570, and those of yellow, magenta or cyan couplers of such a type are described in European Pat. No. 96,570 and West German patent application (OLS) No. 3,234,533.

Dye-forming couplers and the above-described special couplers, other than those forming diffusible dyes, may take a polymeric form, including a dimeric form. Typical representatives of polymerized dye-forming couplers are described in U.S. Pat. Nos. 3,451,820 and 4,080,211. Specific examples of polymerized magenta couplers are described in British Pat. No. 2,102, 173, and U.S. Pat. No. 4,367,282.

Two or more of various kinds of couplers which can be used in the present invention can be incorporated in the same light-sensitive layer, or the same coupler can be incorporated in two or more different layers, depending on characteristics required of the sensitive material to be produced.

Couplers which can be used in the present invention can be introduced into a sensitive material using various known dispersing processes. A solid dispersing process, a caustic dispersing process, preferably a latex dispersing process, and more preferably an oil-in-water dispersing process are cited as typical instances. In an oil-in-water dispersing process, a coupler is dissolved in a single solvent of a high boiling organic solvent having a boiling point of 175° C. or higher or a so-called auxiliary solvent having a low boiling point, or in a mixture of these solvents and then finely dispersed into an aqueous medium such as water, an aqueous solution of gelatin or the like in the presence of a surface active agent. Suitable examples of high boiling organic solvents are described, e.g., in U.S. Pat. No. 2,322,027, and so on.

Standard amounts of color couplers can be used in the present invention are within the range of 0.001 to 1 mol per mol of light-sensitive silver halide. Preferably, yellow couplers are used in an amount of from 0.01 to 0.05 mol, magenta couplers in an amount of from 0.003 to 0.3 mol, and cyan couplers in an amount of from 0.002 to 0.3 mol, per mol of light-sensitive silver halide.

The sensitive material produced in accordance with the present invention may contain hydroquinone derivatives, aminophenol derivatives, amines, gallic acid derivatives, catechol derivatives, ascorbic acid derivatives, colorless couplers, sulfonamidophenol derivatives and so on as a color fog inhibitor or a color mixing inhibitor.

The sensitive material of the present invention can contain various kinds of discoloration inhibitors. Representative of the organic discoloration inhibitors are hydroquinones, 6-hydroxychromans, 5-hydroxycoumarans, spirochromans, p-alkoxyphenols, hindered phenols including bisphenols as main members, gallic acid derivatives, methylenedioxybenzenes, aminophenols, hindered amines, and ether or ester derivatives obtained by silylating or alkylating a phenolic hydroxyl group of the above-cited compounds each. In addition, metal complex salts represented by (bissalicylaldoximato)-nickle complexes and (bis-N,N-dialkyldithiocarbamato)nickel complexes can be employed as discoloration inhibitor.

For prevention of deterioration of yellow dye images due to heat, moisture and light, compounds having both hindered amine and hindered phenol moieties in a molecule can produce a desirable effect. In order to prevent magenta dye images from suffering deterioration, particularly due to light, spiroindanes described in Japanese patent application (OPI) No. 159644/81, and chromans substituted with a hydroquinone di- or monoether described in Japanese patent application (OPI) No. 89835/80 are employed to advantage.

The sensitive material of the present invention can contain an ultraviolet absorbing agent in a hydrophilic colloidal layer thereof.

The sensitive material of the present invention may further contain water-soluble dyes in a hydrophilic colloidal layer thereof as a filter dye, or for various purposes, e.g., prevention of irradiation, antihalation, and so on.

The sensitive material of the present invention may contain a brightening agent of stilbene type, triazine type, oxazole type, coumarin type or the like in a photographic emulsion layer or some other hdyrophilic colloidal layer thereof. A brightening agent to be used may be a water-soluble one, or a water-insoluble brightening agent may be used in the form of a dispersion.

Gelatins are used to advantage as binder or protective colloid to be contained in emulsion layers and interlayers of the sensitive material of the present invention. Also, hydrophilic colloids other than gelatin can be used.

Specific examples of gelatins include not only generally used lime-processed gelatin, but also acid-processed gelatin, enzyme-processed gelatin as described in *Bull. Soc. Sci. Phot. Japan,* No. 16, p. 30 (1966), hydrolysis products of gelatin and enzymatic degradation products of gelatin.

The sensitive material of the present invention may contain organic or inorganic hardeners in photographic light-sensitive layers or hydrophilic colloidal layers constituting the backing layers.

The sensitive material of the present invention may contain one or more of surface active agents for various purposes such as coating aids, prevention of electrification, improvement of slipping properties, emulsifying dispersion, prevention of adhesion, and improvement of photographic characteristics (e.g., acceleration of development, increase in contrast, sensitization, and so on).

In addition to the above-described additives, the sensitive material of the present invention may contain various stabilizers, stain inhibitors, developing agents or precursors thereof, development accelerators or precursors thereof, lubricants, mordants, matting agents, antistatic agents, plasticizers, or other additives useful for a photographic light-sensitive material. Typical representative of these additives are described in *Research Disclosure,* No. 17643 (December, 1978) and ibid., No. 18716 (November, 1979).

The present invention can also be applied to a multilayer multicolor photographic material having at least two different color sensitivities on a support. A multilayer color photographic material has, in general, at least one red-sensitive emulsion layer, at least one green-sensitive emulsion layer, and at least one blue-sensitive emulsion layer on a support. The order of these layers can be varied as desired. Each of the above-described emulsion layers may be made of two or more emulsion layers differing in sensitivity. Further, a light-insensitive layer may be sandwiched between any pair of such constituent emulsion layers having the same color sensitivity.

It is desirable for the sensitive material according to the present invention to provide properly auxiliary layers such as a protective layer, an inter-layer, a filter layer, an antihalation layer, a backing layer or so on in addition to the silver halide photographic emulsion layers.

In the photographic light-sensitive material of the present invention, photographic emulsion layers and other layers are coated on a flexible support such as a plastic film, a sheet of paper, a piece of cloth or the like, or a rigid support such as glass, ceramic, metal or like plate.

The present invention can be applied to various kinds of color photographic materials. Representative of color photographic materials to which the present invention can be applied are color negative films for amateur use or motion picture use, color reversal films for slide use or television use, color paper, color positive films, and color reversal paper. Among these materials, color paper is preferred over others. The present invention can also be applied to a black-and-white photographic material which utilizes the process of mixing three color couplers, as described in *Research Disclosure,* No. 17123 (July, 1978).

A color developing solution which can be used for development processing of the photographic material of the present invention is an alkaline aqueous solution containing preferably an aromatic primary amine type color developing agent as a main component. Preferred developing agents of such a type are p-phenylenediamine compounds. Representative of such compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylanilien, and sulfates, hydrochlorides or p-toluenesulfonates of the above-cited anilines.

The color developing solution can generally contain pH buffering agents such as carbonates, borates or phosphates of alkali metals, and development inhibitors or antifoggants such as bromides, iodides, benzimidazoles, benzothiazoles or mercapto compounds. Further, preservatives such as hydroxylamines or sulfites, organic solvents such as triethanolamine or diethylene glycol, development accelerators such as benzyl alcohol, polyethylene glycol, quaternary ammonium salts or amines, dye-forming couplers, competing couplers, nucleating agents such as sodium borohydride, auxiliary developers such as 1-phenyl-3-pyrazolidones, viscosity-imparting agents, various kinds of chelating agents represented by aminopolycarboxylic acids, aminopolyphosphonic acids, alkylphosphonic acids, phosphonocarboxylic acids and the like, antioxidants described in West German patent application (OLS) No. 2,622,950, and so on may be added to the color developing solution, if desired.

After exposure and subsequent color development, the photographic material of the present invention is subjected to a bleach processing and a fix processing (which may be carried out in either a monobath or separate baths).

Suitable examples of bleaching agents which can be used include complex salts of organic acids and Fe(III) or Co(III). Specific examples of organic acids usable for producing such complex salts include ethylenediaminetetraacetic acid, diethylenetriaminepentaacetic acid, nitrilotriacetic acid, 1,3-diamino-2-propanol tetraacetic acid and other aminopolycarboxylic acids, citric acid, tartaric acid and malic acid. Of these complex salts, ethylenediaminetetraacetatoferrate(III) complex salts and ethylenetriaminepentaacetatoferrate(III) complex salts are particularly useful in a bleach-fix bath.

To a bleach-fix bath may be added various accelerators in combination. For example, in addition to bromine ion and iodine ion, thiourea compounds as described in U.S. Pat. No. 3,706,561, Japanese Patent Publication Nos. 8506/70 and 26586/74, and Japanese patent application (OPI) Nos. 32735/78, 36233/78 and 37016/78; thioether compounds as described in Japanese patent application (OPI) Nos. 124424/78, 95631/78, 57831/78, 32736/78, 65732/78 and 52534/79, U.S. Pat. No. 3,893,858, and so on; heterocyclic compounds as described in Japanese patent application (OPI) Nos. 59644/74, 140129/75, 28426/78, 141623/78, 104232/78 and 35727/79, and so on; thioether compounds as described in Japanese patent application (OPI) Nos. 20832/77, 25064/80 and 26506/80, and so on; tertiary amines as described in Japanese patent application (OPI) No. 84440/73; thiocarbamoyls as described in Japanese patent application (OPI) No. 42349/74; and so on can be employed alone or in combination of two or more thereof. Of these substances, bromine ion, iodine ion, thiol compounds and disulfide compounds function effectively as bleach accelerator. These bleach accelerators are especially effective in bleaching and fixing color photographic materials for picture-taking use.

As examples of usable fixing agents, mention may be made of thiosulfates, thiocyanates, thioether compounds, thioreas, a large amount of iodide, and so on. In general, thiosulfates are used as fixing agent. As the preservatives for a bleach-fix bath or a fixing bath, sulfites, bisulfites and the adducts of carbonyl and bisulfites are preferably used.

After bleach-fix processing or fix processing, a washing processing is generally carried out. In the step of washing, addition of various known compounds may be carried out for the purpose of preventing precipitation and saving washing water. In order to prevent the precipitation from occurring, a water softener such as an inorganic phosphoric acid, an aminopolycarboxylic acid, an organic phosphonic acid, or so on; a germicide and a bactericide for inhibiting various bacteria, waterweeds and molds from breaking out; a hardener represented by a magnesium salt or an aluminum salt; a surface active agent for lightening drying load and preventing drying mark from generating; and so on can be added, if needed. Also, the compounds described in L. E. West, *Photo. Sci. Eng.,* Vol. 6, pp. 344–359 (1965) may be added. In particular, addition of chelating agents and bactericides is effective.

The washing step is, in general, carried out using two or more tanks according to the countercurrent washing method for the purpose of saving water. On the other hand, a multistage countercurrent stabilization processing step as described in Japanese patent application (OPI) No. 8543/82 may be carried out in place of the washing step. To the stabilizing bath are added various kinds of compounds in order to stabilize the developed images. As typical examples of such additives, mention may be made of various buffering agents for adjusting pH to a proper value (ranging generally from 3 to 8), such as those obtained by combining properly acids and alkalis selected from among borates, metaborates, borax, phosphates, carbonates, potassium hydroxide, sodium hydroxide, aqueous amonia, monocarboxylic acids, dicarboxylic acids, polycarboxylic acids and the like, and formaldehyde. The stabilizing bath may further contain a water softener (e.g., inorganic phosphoric acids, aminopolyphosphonic acids, organic phosphonic acids, aminopolyphosphonic acids, phosphocarboxylic acids, or so on), a germicide (e.g., benzisothiazolinone, isothiazolone, 4-thiazolinebenzimidazole, halogenophenols, or so on), a surface active agent, a brightening agent, a hardener and other various kinds of additives, if desired. Two or more kinds of compounds may be used for the same purpose or different purposes.

In addition, it is desired that various ammonium salts, such as ammonium chloride, ammonium nitrate, ammonium sulfate, ammonium phosphate, ammonium sulfite, ammonium thiosulfate and the like, should be added to the stabilizing bath in order to control the pH in the processed film.

A color developing agent may be incorporated into the silver halide color photographic material of the present invention for purposes of simplifying and quickening the photographic processing. Incorporation of the color developing agent is carried out to advantage by using it in the form of a precursor.

Further, various 1-phenyl-3-pyrazolidones may optionally be incorporated in the silver halide color photographic material of the present invention for the purpose of accelerating the color development.

Each of processing solutions is used at a temperature ranging from about 10° C. to about 50° C. in the present invention. Although a standard processing temperature is within the range of 33° C. to 38° C., temperatures higher than the standard temperatures can accelerate the processings to reduce processing time, while lower temperatures can contribute to enhancement of image quality and improvements in stabilities of processing solutions. Furthermore, a processing utilizing cobalt intensification or oxygen peroxide intensification, as described in West German Pat. No. 2,226,770 and U.S. Pat. No. 3,674,499, may be carried out for the purpose of saving silver.

Each of the processing baths may be equipped with a heater, a temperature sensor, a liquid surface sensor, a circulating pump, a filter, a floating lid, a squeezer or so on, if desired.

The present invention is illustrated in greater detail by reference to the following examples. However, the invention is not intended to be construed as being limited to these examples.

EXAMPLE 1

24.2 g of NaCl and 1.1 g of KBr were added to 900 ml of a 3 wt % aqueous solution of gelatin, and dissolved therein. The resulting solution was kept at 55° C., and 22.5 ml of a 17 wt % aqueous solution of $AgNO_3$ and an aqueous alkali halide solution containing 100 g of KBr and 37 g of NaCl in 1,000 ml of water were added thereto over a 5 minute period with vigorous stirring in accordance with a double jet method. During the addition, the amount of the aqueous alkali halide solution which was added was controlled so as to keep the pAg of the reaction system at the initial value.

To the thus prepared emulsion were subsequently added 566.4 ml of an aqueous $AgNO_3$ solution having the same concentration as described above and an aqueous alkali halide solution having the same composition and the concentration as described above according to a double jet method over a 64 minute period. During the addition time, the volume of the aqueous $AgNO_3$ solution added per minute (v.ml/min) was increased accelerately so as to obey the following equation at the point of t minutes after beginning of the addition:

$$v=4.4+0.138t$$

On the other hand, the amount of the aqueous alkali halide solution which was added was altered with the passage of time so as to retain the initial pAg value in the reaction system.

After the soluble salts were removed from the resulting emulsion using a sedimentation process, gelatin was further added to the emulsion, and thereby redispersion was brought about. Furthermore, sodium thiosulfate was added to the redispersed emulsion at 50° C. in an amount of 6 mg per mol of silver halide to result in the optimal chemical sensitization.

The thus obtained emulsion was named Emulsion A. In Emulsion A, tabular grains accounted for 85% of the total projection area of the whole silver halide grains contained therein. The mean thickness of the tabular grains was 0.13 micron, the mean aspect ratio thereof was 7, and the mean grain size was 0.67 micron by measurement with a Coulter Counter model TA-II, made by Coulter Electronics. The content of AgBr was 85 mol %.

Separately, 8.0 g of NaCl were added to 900 ml of a 3 wt % aqueous solution of gelatin, and dissolved therein. The resulting solution was kept at 65° C., and 22.5 ml of a 17 wt % aqueous solution of $AgNO_3$ and an aqueous alkali halide solution containing 101.2 g of KBr and 26.5 g of NaCl in 1,000 ml of water were added thereto over a 5 minute period with vigorous stirring in accordance with a double jet method. During the addition, the amount of the aqueous alkali halide solution which was added was controlled so as to keep pAg of the reaction system at the initial value. To the thus prepared emulsion were subsequently added over a 60 minute period 566.4 ml of an aqueous $AgNO_3$ solution having the same concentration as described above and an aqueous alkali halide solution having the same composition and the concentration as described above according to a double jet method. At this addition time also, the amount of the alkali halide aqueous solution which was added was controlled so as to keep the pAg value constant.

After the soluble salts were removed from the resulting emulsion using a sedimentation process, gelatin was further added to the emulsion, and thereby redispersion was brought about. Furthermore, sodium thiosulfate was added to the redispersed emulsion at 50° C. in an amount of 6 mg per mol of silver halide to result in the optimal chemical sensitization. The thus obtained emulsion was named Emulsion B.

Silver halide grains contained in Emulsion B had an octahedral form, and the mean grain size thereof was 0.65 micron when determined in the same manner as in Emulsion A. In addition, the content of AgBr was 85 mol %.

Separately, 1.0 g of NaCl were added to 900 ml of a 3 wt % aqueous solution of gelatin, and dissolved therein. The resulting solution was kept at 80° C., and 22.5 ml of a 17 wt % aqueous solution of $AgNO_3$ and an aqueous alkali halide solution containing 101.2 g of KBr and 11.0 g of NaCl in 1,000 ml of water were added thereto over a 15 minute period with vigorous stirring in accordance with a double jet method. During the addition, the amount of the aqueous alkali halide solution which was added was controlled so as to keep pAg of the reaction system at the initial value. To the thus prepared emulsion were subsequently added over a 60 minute period 566.4 ml of an aqueous $AgNO_3$ solution having the same concentration as described above and an aqueous alkali halide solution having the same composition and the concentration as described above according to a double jet method. At this addition time also, the amount of the alkali halide aqueous solution which was added was controlled so as to keep the pAg value constant.

After the soluble salts were removed from the resulting emulsion using a sedimentation process, gelatin was further added to the emulsion, and thereby redispersion was brought about. Furthermore, sodium thiosulfate was added to the redispersed emulsion at 50° C. in an amount of 17 mg per mol of silver halide to result in the optimal chemical sensitization. The thus obtained emulsion was named Emulsion C.

Silver halide grains contained in Emulsion C had a cubic form, and the mean grain size thereof was 0.60 micron when determined in the same manner as in Emulsion A. In addition, the content of AgBr was 85 mol %.

In a mixed solvent composed of 16.0 g of dibutyl phthalate (DBP) and 60 ml of ethyl acetate were dissolved Cyan Coupler (I-4) or Cyan Coupler (I-22), which is included in the cyan couplers having the general formula (I), alone or in combination with another Cyan Coupler (*a) or (*b), and further together with Discoloration Inhibitor (*c) and Ultraviolet Absorbents (*d), (*e) and (*f). The resulting solution was emulsified and dispersed in 300 ml of a 10 wt % aqueous solution of gelatin containing 1.2 g of sodium dodecylbenzenesulfonate. Thus, six kinds of Emulsified Dispersions (i) to (vi) as shown in Table 1 were obtained.

TABLE 1

| Emulsified Dispersion | Cyan Coupler | Additives |
|---|---|---|
| (i) | (I-4) 30.0 g | (*c) 14.0 g, (*d) 2.7 g<br>(*e) 5.3 g, (*f) 6.7 g |
| (ii) | (I-4) 15.0 g<br>(*a) 12.3 g | (*c) 14.0 g, (*d) 2.7 g<br>(*e) 5.3 g, (*f) 6.7 g |
| (iii) | (I-4) 15.0 g<br>(*b) 12.0 g | (*c) 14.0 g, (*d) 2.7 g<br>(*e) 5.3 g, (*f) 6.7 g |
| (iv) | (I-22) 32.0 g | (*c) 14.0 g, (*d) 2.7 g<br>(*e) 5.3 g, (*f) 6.7 g |
| (v) | (I-22) 16.0 g<br>(*a) 12.3 g | (*c) 14.0 g, (*d) 2.7 g<br>(*e) 5.3 g, (*f) 6.7 g |
| (vi) | (I-22) 16.0 g<br>(*b) 11.9 g | (*c) 14.0 g, (*d) 2.7 g<br>(*e) 5.3 g, (*f) 6.7 g |

(*a) Cyan Coupler

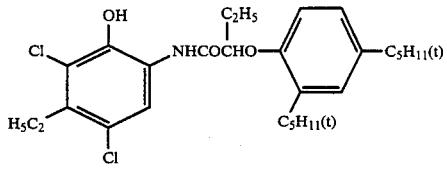

(*b) Cyan Coupler

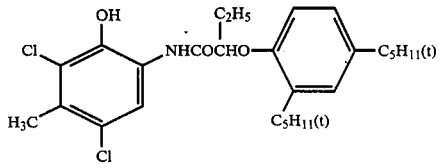

(*c) Discoloration Inhibitor

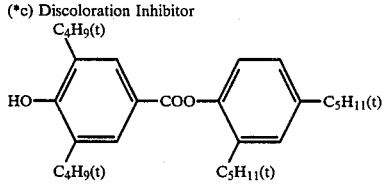

(*d) Ultraviolet Absorbent

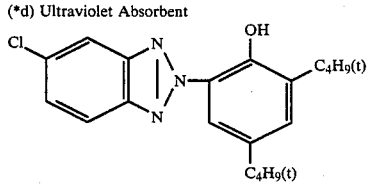

(*e) Ultraviolet Absorbent

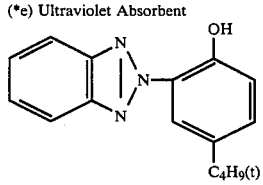

(*f) Ultraviolet Absorbent

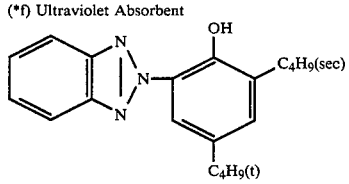

Emulsions A to C prepared in the above-described manner were spectrally sensitized with Spectral Sensitizing Dye (*g) (by adding (*g) in such an amount as to achieve the maximum sensitivity within the range where color stain matters little). Each of these spectrally sensitized emulsions were then combined with each of Emulsified Dispersions (i) to (vi) to form 18 different emulsions for coating. Each of the combined emulsions were divided into 3 portions, and they were allowed to stand for 10 minutes at 40° C., for 2 hours at 40° C. and for 8 hours at 40° C., respectively, in order to examine changes in photographic properties with time having elapsed after preparation of the emulsion to be coated. After the lapse of a prescribed period of time, each of the combined emulsions was coated on a sheet of paper laminated with polyethylene on both sides. On the emulsion-coated side, titanium dioxide was incorporated in the polyethylene laminate, and gelatin containing a slight amount of ultramarine was coated as a protective layer. In each layer, sodium salt of 2,4-dichloro-6-hydroxy-s-triazine was employed as hardener. Coverages of ingredients by which the coated layers were constituted are summarized in Table 2.

(*g) Spectral Sensitizing Dye

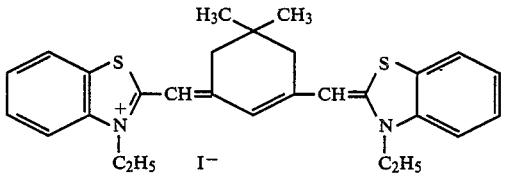

The desensitizing degree of Spectral Sensitizing Dye (*g) was determined at 23 by the testing method described hereinbefore.

TABLE 2

| | |
|---|---|
| Protective Layer: | |
| Gelatin | 1,500 mg/m$^2$ |
| Emulsion Layer: | |
| Silver Chlorobromide Emulsion (bromide content: 85 mol %) (refer to Table 3 below) | silver 300 mg/m$^2$ |
| Cyan Coupler (refer to Table 3 below) | in total 0.40 mol/m$^2$ |
| Ultraviolet Absorbents ((*d)/(*e)/(*f)) | 40/80/100 mg/m$^2$ |
| Discoloration Inhibitor (*c) | 200 mg/m$^2$ |
| Cyan Coupler Solvent (DBP) | 240 mg/m$^2$ |
| Gelatin | 600 mg/m$^2$ |
| Support: | |
| Paper laminated with polyethylene on both sides | |

Photographic properties of the thus produced samples each were examined in the following manner.

Each of the 18 samples was subjected to gradient exposure for sensitometry through a red filter using an enlarging apparatus (Fuji Color Head 690, produced by Fuji Photo Film Co., Ltd.), and then to development processing including the following steps.

| Processing Step | Temperature (°C.) | Time (min) |
|---|---|---|
| Development | 33 | 3.5 |
| Bleach-Fix | 33 | 1.5 |
| Washing | 28–35 | 3.0 |

| Developing Solution: | |
|---|---|
| Trisodium Nitrilotriacetate | 2.0 g |
| Benzyl Alcohol | 15 ml |
| Diethylene Glycol | 10 ml |
| $Na_2SO_3$ | 2.0 g |
| KBr | 0.5 g |
| Hydroxylamine Sulfate | 3.0 g |
| 4-Amino-3-methyl-N—ethyl-N—[β-(methanesulfonamido)ethyl]-p-phenylenediamine Sulfate | 5.0 g |
| $Na_2CO_3$ (monohydrate) | 30 g |

-continued

| | |
|---|---|
| Water to make | 1 liter (pH 10.1) |
| Bleach-Fix Bath: | |
| Ammonium Thiosulfate (70 wt %) | 150 ml |
| $Na_2SO_3$ | 15 g |
| $NH_4[Fe(EDTA)]$ | 55 g |
| $(EDTA)_2.2Na$ | 4 g |
| Water to make (pH 6.9) | 1 liter |

After the conclusion of the processing, a color density of the image developed in each sample was measured and therefrom a change in sensitivity with time having elapsed after preparation of the emulsion to be coated was determined. The contents of the 18 different emulsions coated, and sensitivity changes are shown in Table 3 (wherein the sensitivity of the sample obtained by coating the emulsion which has been allowed to stand at 40° C. for 10 minutes after the preparation thereof was taken as 100).

TABLE 3

| Sample No. | Emulsion Used | Coupler-Emulsified Dispersion | Relative Sensitivity 10 Min | 2 Hr | 8 Hr | Remarks |
|---|---|---|---|---|---|---|
| 1 | A | (i) | 100 | 97 | 94 | Invention |
| 2 | A | (ii) | 100 | 98 | 96 | " |
| 3 | A | (iii) | 100 | 98 | 95 | " |
| 4 | A | (iv) | 100 | 98 | 95 | " |
| 5 | A | (v) | 100 | 99 | 96 | " |
| 6 | A | (vi) | 100 | 98 | 97 | " |
| 7 | B | (i) | 100 | 72 | 46 | Comparison |
| 8 | B | (ii) | 100 | 88 | 73 | " |
| 9 | B | (iii) | 100 | 86 | 72 | " |
| 10 | B | (iv) | 100 | 74 | 53 | " |
| 11 | B | (v) | 100 | 89 | 78 | " |
| 12 | B | (vi) | 100 | 87 | 77 | " |
| 13 | C | (i) | 100 | 78 | 59 | " |
| 14 | C | (ii) | 100 | 87 | 79 | " |
| is | C | (iii) | 100 | 86 | 74 | " |
| 16 | C | (iv) | 100 | 79 | 63 | " |
| 17 | C | (v) | 100 | 89 | 76 | " |
| 18 | C | (vi) | 100 | 83 | 75 | " |

As can be seen from the results in Table 3, desensitization due to time having elapsed from the preparation of a photographic emulsion until the coating of the emulsion was remarkably diminished by using the tabular silver chlorobromide (which had a bromide content of 85 mol %) emulsion having a mean aspect ratio of 7, and further containing a cyan coupler of the 2,5-diacylaminophenol type in accordance with the present invention.

EXAMPLE 2

Magenta Coupler (*h) and Discoloration Inhibitor (*i) were dissolved together in a mixed solvent made of tri(n-octyl) phosphate (TOP) and ethyl acetate, and dispersed therein in an emulsified condition in the same manner as in Example 1.

(*h) Magenta Coupler

-continued

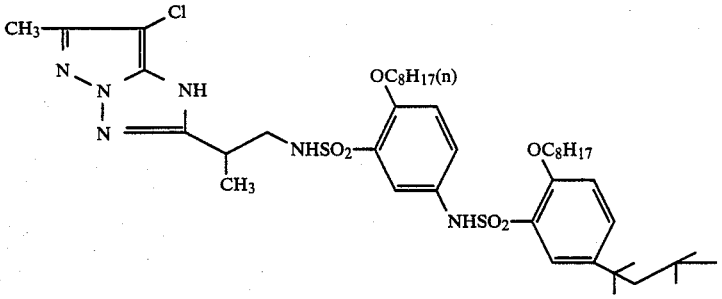

(*i) Discoloration Inhibitor

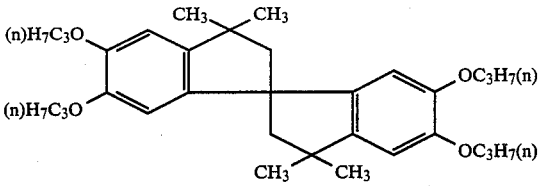

The thus obtained emulsified dispersion was mixed with an emulsion comprising silver chlorobromide grains having a size of 0.5 micron and a bromide content of 70 mol % (which had been chemically sensitized, and spectrally sensitized with Spectral Sensitizing Dye (*j)) to prepare a coating composition of the green-sensitive emulsion.

(*j) Spectral Sensitizing Dye

-continued

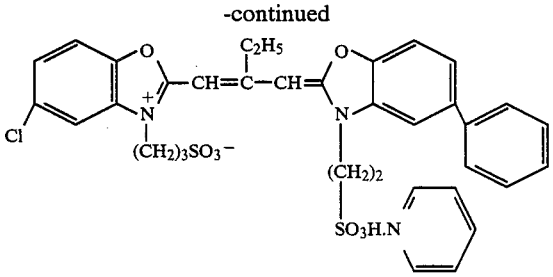

Separately, Yellow Coupler (*k) and Discoloration Inhibitor (*l) were dissolved together in a mixture of dibutyl phthalate (DBP) and ethyl acetate, and the emulsified dispersion of this coupler was prepared in the same manner as in Example 1.

(*k) Yellow Coupler

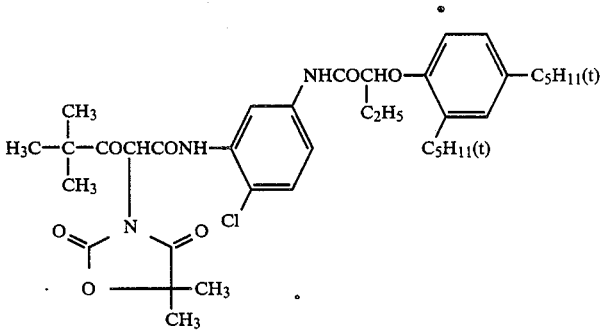

(*l) Discoloration Inhibitor

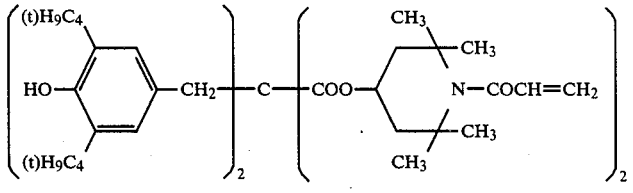

This emulsified dispersion was mixed with an emulsion comprising silver chlorobromide grains having a size of 0.8 micron and a bromide content of 80 mol % (which had been chemically sensitized, and further spectrally sensitized with Spectral Sensitizing Dye (*m)). Thus, a coating composition for blue-sensitive emulsion layer was prepared.

(*m) Spectral Sensitizing Dye

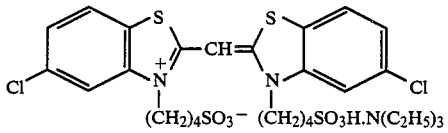

After spectral sensitization with Spectral Sensitizing Dye (*g), the same Emulsions A to C as prepared in Example 1 were combined with the Emulsified Dispersions of Cyan Couplers (i) to (vi) to prepare 18 different coating compositions for the red-sensitive silver halide emulsion layer. A multilayer sample was made using one of these red-sensitive coating compositions together with the foregoing green-sensitive coating composition and the foregoing blue-sensitive coating composition. In order to prevent irradiation, the following compound was employed in each layer.

In the red-sensitive emulsion layer:

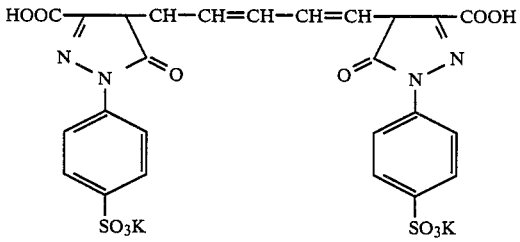

In the green-sensitive emulsion layer:

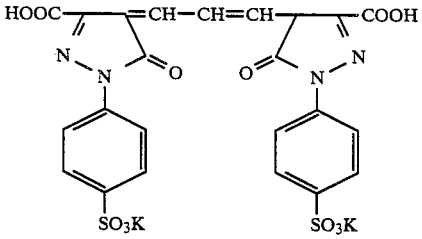

In this example also, each of the combined emulsions was divided into three portions, and they were allowed to stand at 40° C. for 10 min, 2 hr, and 8 hr, respectively, after the preparation thereof, and then subjected to a coating step.

The resulting samples were subjected to gradient exposure through a red filter, a green filter or a blue filter in the same manner as employed in Example 1, and then to color development processing. Thereafter, each emulsion layer was examined for sensitivity.

In order to examine dark fastness of the dye images formed, the processed samples were preserved at 80° C. for 4 weeks in the dark, or for 8 weeks in the dark under the condition of 60° C. and 70% RH, and then examined for color density of the dye images. The density measurement was carried out at the part which had a density of 1.0 before the discoloration test using a densitometer of Macbeth RD-514 type.

Coverages of the ingredients employed in producing this multilayer sample are set forth in Table 4, and the contents of the red-sensitive emulsion employed in each sample and the results of the discoloration test are summarized in Table 5. (Therein, the sensitivities are shown as relative values, with the red-sensitive emulsion, the green-sensitive emulsion and the blue-sensitive emulsion, which have been allowed to stand for 10 minutes before coating, being taken as 100, respectively.)

TABLE 4

| | |
|---|---|
| Seventh Layer: Protective Layer | |
| Gelatin | 1,500 mg/m$^2$ |
| Sixth Layer: | |
| Ultraviolet Absorbing Layer | |
| Ultraviolet Absorbents ((*d)/(*e)/(*f)) | 50/150/300 mg/m$^2$ |
| Ultraviolet Absorbent Solvent (DBP) | 200 mg/m$^2$ |
| Gelatin | 1,500 mg/m$^2$ |
| Fifth Layer: Red-Sensitive Layer | |
| Silver Chlorobromide Emulsion (bromide content: 85 mol %) | silver 300 mg/m$^2$ (see Table 5) |
| Cyan Coupler (see Table 5) | in total 0.40 mol/m$^2$ |
| Ultraviolet Absorbents ((*d)/(*e)/(*f)) | 40/80/100 mg/m$^2$ |
| Discoloration Inhibitor (*c) | 200 mg/m$^2$ |
| Cyan Coupler Solvent (DBP) | 240 mg/m$^2$ |
| Gelatin | 600 mg/m$^2$ |
| Fourth Layer: | |
| Ultraviolet Absorbing Layer | |
| Ultraviolet Absorbents ((*d)/(*e)/(*f)) | 15/45/90 mg/m$^2$ |
| Ultraviolet Absorbent Solvent (DBP) | 60 mg/m$^2$ |
| Gelatin | 500 mg/m$^2$ |
| Third Layer: | |
| Green-Sensitive Layer | |
| Silver Chlorobromide Emulsion (bromide content: 70 mol %) | silver 200 mg/m$^2$ |
| Magenta Coupler (*h) | 290 mg/m$^2$ |
| Discoloration Inhibitor (*i) | 168 mg/m$^2$ |
| Magenta Coupler Solvent (TOP) | 440 mg/m$^2$ |
| Gelatin | 1,000 mg/m$^2$ |
| Second Layer: | |
| Color-Mixing Preventing Layer | |
| Gelatin | 1,500 mg/m$^2$ |
| First Layer: | |
| Blue-Sensitive Layer | |
| Silver Chlorobromide Emulsion (bromide content: 80 mol %) | silver 400 mg/m$^2$ |
| Yellow Coupler (*k) | 600 mg/m$^2$ |
| Discoloration Inhibitor (*l) | 150 mg/m$^2$ |
| Yellow Coupler Solvent (DBP) | 600 mg/m$^2$ |
| Gelatin | 1,200 mg/m$^2$ |
| Support: | |
| Paper laminated with polyethylene on both sides | |

TABLE 5

| Sample No. | Emulsion | Emulsified Dispersion | Relative Sensitivity of Red Sensitive Layer: Lapse of 10 Min | Lapse of 2 Hr | Lapse of 8 Hr | Relative Sensitivity of Green-Sensitive Layer: Lapse of 10 Min | Lapse of 2 Hr | Lapse of 8 Hr | Relative Sensitivity of Blue-Sensitive Layer: Lapse of 10 Min | Lapse of 2 Hr | Lapse of 8 Hr | 80° C., 4 Weeks: $D_R$ | $D_G$ | $D_B$ | 60° C., 70% RH 8 Weeks: $D_R$ | $D_G$ | $D_B$ |
|---|---|---|---|---|---|---|---|---|---|---|---|---|---|---|---|---|---|
| 1 | A | (i) | 100 | 98 | 95 | 100 | 101 | 100 | 100 | 99 | 97 | 0.99 | 0.99 | 0.99 | 0.97 | 0.99 | 0.98 |
| 2 | A | (ii) | 100 | 98 | 96 | 100 | 9 | 101 | 100 | 98 | 97 | 0.98 | 0.98 | 1.00 | 0.96 | 0.97 | 0.98 |
| 3 | A | (iii) | 100 | 97 | 94 | 100 | 100 | 102 | 100 | 98 | 96 | 0.94 | 1.00 | 1.00 | 0.91 | 0.98 | 0.99 |
| 4 | A | (iv) | 100 | 98 | 96 | 100 | 101 | 102 | 100 | 99 | 95 | 1.00 | 1.00 | 0.98 | 0.98 | 0.97 | 0.99 |
| 5 | A | (v) | 100 | 98 | 95 | 100 | 100 | 101 | 100 | 98 | 97 | 0.99 | 0.99 | 0.99 | 0.95 | 0.98 | 0.98 |
| 6 | A | (vi) | 100 | 97 | 95 | 100 | 98 | 101 | 100 | 99 | 98 | 0.95 | 1.00 | 0.99 | 0.92 | 0.98 | 0.99 |
| 7 | B | (i) | 100 | 70 | 46 | 100 | 100 | 100 | 100 | 98 | 97 | 0.99 | 1.00 | 0.98 | 0.98 | 0.97 | 0.99 |
| 8 | B | (ii) | 100 | 87 | 74 | 100 | 99 | 101 | 100 | 97 | 95 | 0.99 | 0.99 | 1.00 | 0.97 | 0.99 | 0.98 |
| 9 | B | (iii) | 100 | 87 | 73 | 100 | 101 | 102 | 100 | 97 | 96 | 0.96 | 0.98 | 1.00 | 0.91 | 0.98 | 0.97 |
| 10 | B | (iv) | 100 | 74 | 52 | 100 | 101 | 102 | 100 | 97 | 95 | 0.99 | 0.99 | 0.99 | 0.97 | 0.97 | 0.98 |
| 11 | B | (v) | 100 | 88 | 77 | 100 | 101 | 100 | 100 | 99 | 98 | 0.98 | 1.00 | 0.99 | 0.95 | 0.99 | 0.98 |
| 12 | B | (vi) | 100 | 87 | 75 | 100 | 99 | 101 | 100 | 99 | 97 | 0.95 | 0.98 | 0.98 | 0.93 | 0.98 | 0.99 |
| 13 | C | (i) | 100 | 79 | 57 | 100 | 101 | 100 | 100 | 97 | 95 | 0.98 | 0.99 | 0.99 | 0.96 | 0.98 | 0.97 |
| 14 | C | (ii) | 100 | 87 | 79 | 100 | 98 | 102 | 100 | 98 | 96 | 0.98 | 0.99 | 0.99 | 0.95 | 0.97 | 0.98 |
| 15 | C | (iii) | 100 | 85 | 75 | 100 | 101 | 100 | 100 | 98 | 97 | 0.94 | 0.99 | 0.9 | 0.92 | 0.98 | 0.99 |
| 16 | C | (iv) | 100 | 78 | 63 | 100 | 99 | 101 | 100 | 96 | 95 | 0.99 | 0.99 | 1.00 | 0.98 | 0.98 | 0.98 |
| 17 | C | (v) | 100 | 89 | 76 | 100 | 100 | 101 | 100 | 99 | 98 | 0.97 | 0.98 | 1.00 | 0.97 | 0.97 | 0.99 |
| 18 | C | (vi) | 100 | 82 | 75 | 100 | 100 | 102 | 100 | 98 | 95 | 0.93 | 1.00 | 1.00 | 0.94 | 0.98 | 0.98 |

$D_B$, $D_G$ and $D_R$ represent density of yellow dye image, that of magenta dye image and that of cyan dye image, respectively.
Sample Nos. 1 to 6 are the samples according to the present invention, and Sample Nos. 7 to 18 are comparative samples.

In accordance with the present invention, as can be seen from the results in Table 5, it becomes feasible to securely produce a silver halide color photographic material which can produce dye images excellent in dark fastness and maintain color balance even when left under a discoloration condition.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material which comprises a support having provided thereon at least one silver halide emulsion layer containing a cyan dye image-forming coupler represented by the following general formula (I), said emulsion layer containing silver chlorobromide grains containing 40 to 95 mol % bromide in which tabular silver halide grains having a means aspect ratio of 5 to 8 amount to 85% or more based on the total projection area of the whole grains, and being spectrally sensitized with a cyanine dye of the trimethine or pentamethine type or a merocyanine dye, which dye has a desensitization degree of 10 or more,

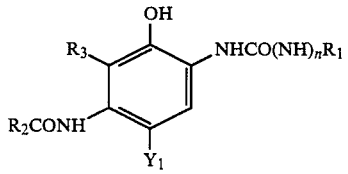

(I)

wherein $R_1$ and $R_2$ each represents a substituted or unsubstituted aliphatic, aromatic or heterocyclic group; $R_3$ represents a hydrogen atom, a halogen atom, a substituted or unsubstituted aliphatic or aromatic group or an acylamino group, and further $R_3$ may be non-metallic atomic groups which form with $R_2$ a nitrogen-containing 5- or 6-membered ring; $Y_1$ represents a hydrogen atom, or a group which is eliminable upon an oxidative coupling reaction with a developing agent; and n represents 0 or 1; and further, the coupler may take a polymeric form, including dimeric form, via a group represented by $R_1$, $R_2$ or $Y_1$.

2. The silver halide color photographic material according to claim 1, wherein the tabular silver halide grains have a diameter ranging from 0.2 to 2.4 microns and a thickness of 0.3 micron or less.

3. The silver halide color photographic material according to claim 1, wherein the cyanine dye is selected from those represented by formula (II) or (III)

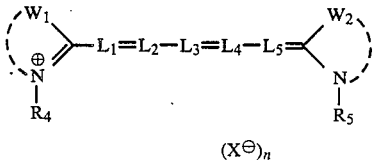

(II)

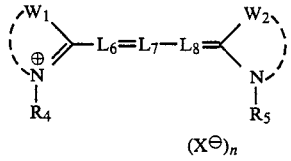

(III)

wherein $W_1$ and $W_2$ may be the same or different, and each represents a non-metallic atomic group necessary to complete a benzothiazole nucleus, a naphthothiazole nucleus, a benzoxazole nucleus, or a naphthoxazole nucleus, wherein each nucleus may be substituted; $R_4$ and $R_5$ may be the same or different, and each is an alkyl group, or a substituted alkyl group; $L_1$, $L_2$, $L_3$, $L_4$, $L_5$, $L_6$, $L_7$ and $L_8$ each represents a methine group, or a substituted methine group, and $L_2$ and $L_4$ may further combine with each other to form a ring; $X^-$ represents an anion; and n represents 1 or 0, but n is equal to 0 when the dye forms an inner salt.

4. The silver halide color photographic material according to claim 1, wherein the merocyanine dye is a tetramethine type merocyanine dye.

* * * * *